United States Patent [19]

Davis

[11] 4,352,399

[45] Oct. 5, 1982

[54] BIT BREAKER AND HANDLE

[76] Inventor: Kenneth Davis, P.O. Box 7906, Midland, Tex. 79703

[21] Appl. No.: 202,687

[22] Filed: Oct. 31, 1980

[51] Int. Cl.[3] ..... E21B 10/00

[52] U.S. Cl. ..... 175/315; 175/329; 175/393; 173/164; 81/90 B

[58] Field of Search ..... 175/315, 329, 327, 307, 175/393, 87; 81/90 B, 90 C, 121 R; 173/164

[56] References Cited

U.S. PATENT DOCUMENTS 2,719,025 9/1955 Shore ..... 81/90 B
3,554,298 1/1971 Klein ..... 173/164

OTHER PUBLICATIONS

"Sparkle Aplenty", *Drilling-Dew,* Dec. 1976, p. 61, 175-329.

*Primary Examiner*—William F. Pate, III
*Attorney, Agent, or Firm*—Marcus L. Bates

[57] ABSTRACT

A bit breaker and handle for use in conjunction with a drill bit. The bit breaker is in the form of a plate member which is provided with an outside edge having a configuration to be drivingly received within the kelly drive of a drilling rig turntable. The plate is apertured to telescopingly receive a marginal length of the main body of the bit therethrough. A plurality of lugs are circumferentially placed about the aperture. The lugs are slidably received within an enlarged marginal length of the external bit passageways, and abuttingly engage a shoulder formed at the outlet end of the passageway. The drill tubing is held while the turntable is rotated in the appropriate direction to "make up" or "break out" the tubing threads respective to the threads of the bit. The external passageways are further provided with radially extending counterbores which receive the marginal end of a handle therewithin so that the bit can be easily lifted respective to the plate member.

9 Claims, 6 Drawing Figures

BIT BREAKER AND HANDLE

BACKGROUND OF THE INVENTION

The drilling of boreholes with a rotary drilling rig requires that a drill bit be attached to or removed from the end of a tubing string from time to time. Drill bits are extremely heavy and difficult for roughnecks to handle. Usually one or more people are required for the difficult task of manually screwing the bit onto or off of the end of the tubing string.

It has been proposed to use a bit breaker wherein a plate member is apertured and provided with lugs for engagement with the external flow passageways formed exteriorly of a bit. However, such a tool is dangerous to use in proximity of the borehole for the reason that the bit could inadvertently be dropped to the bottom of the wellbore. This is a catastrophic event in the oil field and calls for an expensive fishing job to be carried out by experts.

It would, therefore, be desirable to have made available a tool which could be placed in the rotary table, and within which the drill bit could be safely seated in such a manner that the bit is precluded from falling into the borehole, and at the same time, the bit is controllably rotated in either direction. Such a novel and desirable combination of apparatus would enable the bit to be made up and broke out respective to the drill tubing in a safe and reliable manner. Moreover, it would be convenient if a removal handle could be attached to the bit in a manner which would enable the bit to be lifted and manipulated by two people. Such a desirable combination is also the subject of the present invention.

SUMMARY OF THE INVENTION

The combination with a drill bit, rotary table, and drill tubing of a bit breaker apparatus. The apparatus preferably is in the form of a plate having an outer geometrical configuration which conforms to the general configuration of the kelly drive of a drilling rig so that as the turn table rotates, the plate member rotates therewith.

An axial passageway is formed through the plate member through which the lower marginal end of the bit can be telescopingly received. Circumferentially spaced apart lugs project radially inwardly from the plate member and towards the axial centerline of the passageway. The lugs are of a size to be slidably received in close tolerance relationship within the lower marginal length of the external bit passageway. The bit passageway is reduced in width at the marginal outlet end thereof so as to form a shoulder which abuttingly engages the lugs.

The plate member is seated within the kelly drive of a turntable, the bit is telescopingly received and supported by the plate member. The drill tubing is held stationary as the turntable makes up or breaks out the bit respective to the drill tubing.

A sub combination of the present invention provides opposed radial counterbores formed into the main body portions of the bit. The counterbores receive the marginal end of a handle so that the bit can be easily manipulated by two roughnecks.

Accordingly, a primary object of the present invention is the provision of method and apparatus for making up and breaking out drill bits by employment of the turntable of the drilling rig in order to rotate the bit respective to the drill tubing.

Another object of the present invention is the provision of a bit breaker in combination with a bit, drill tubing, and rotary drilling rig by which the bit can be safely held within the turntable and rotated respective to the drill tubing.

A still further object of the present invention is the provision of a sub combination comprising opposed counterbores formed within the main body of the bit which removably accepts a plurality of handles to enable the bit to be manipulated.

Another and still further object of the present invention is the provision of an adaptor tool by which a drill bit is releasably held respective to the turntable of a rotary rig so that the bit can be made up and broke out respective to the drill tubing.

An additional object of this invention is the provision of a drill bit in combination with a bit breaker tool by which a drilling rig turntable can be used to make up and break out a bit respective to a drill tubing string.

These and various other objects and advantages of the invention will become readily apparent to those skilled in the art upon reading the following detailed description and claims and by referring to the accompanying drawings.

The above objects are attained in accordance with the present invention by the provision of a method for use with apparatus fabricated in a manner substantially as described in the above abstract and summary.

DETAILED DESCRIPTION OF THE PREFERRED EMBODIMENTS

Figure 1:
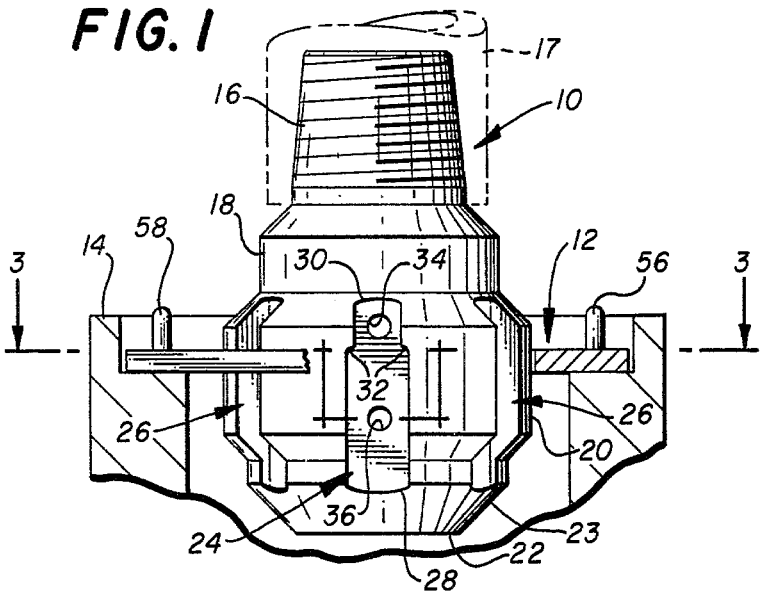
FIG. 1 is a fragmentary, part cross-sectional, side view of one embodiment of the present invention.
Figure 2:
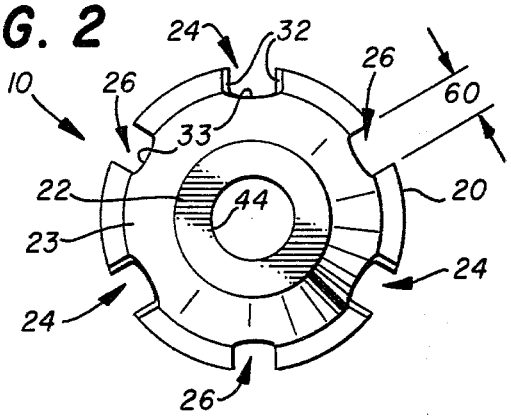
FIG. 2 is a bottom view of the bit disclosed in FIG. 1.
Figure 3:
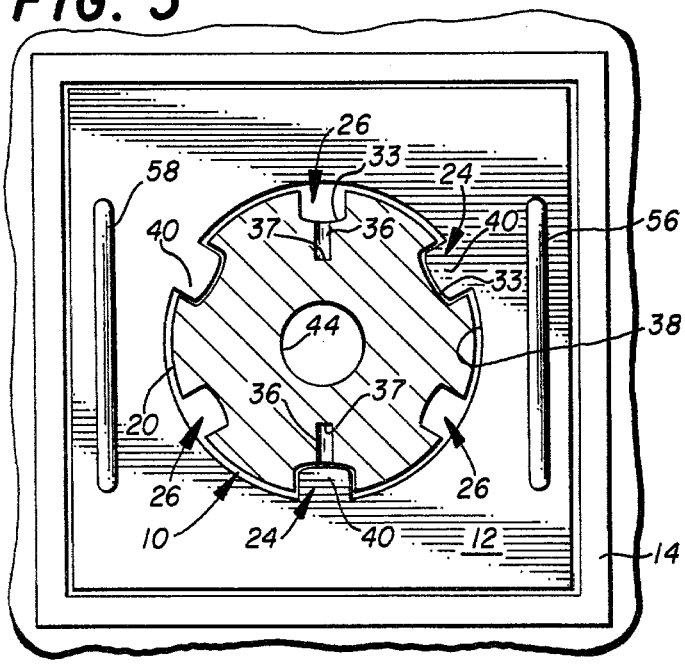
FIG. 3 is a cross-sectional view taken along line 3—3 of FIG. 1.

In FIGS. 1–3 of the drawings, there is disclosed a bit 10 in combination with a bit breaker 12, both of which are made in accordance with the present invention. The bit breaker is seen to be received within the kelly drive 14 of a conventional turntable of a drilling rig. The bit includes the usual threaded pin end 16 to which there is threadedly engaged a string of drill tubing 17.

The bit enlarges into a boss 18 which further enlarges into a main body portion 20. The bottom of the bit has a cutting face 22 and 23 formed thereon, and may include diamond stud assemblies and the like, as exemplified by my co-pending patent application Ser. No. 170,901 filed July 21, 1980.

A plurality of external passageways 24 are radially spaced about the bit. The passageways outwardly open away from the bit and admit the flow of drilling fluid and cuttings across the bit and back uphole, as is known to those skilled in the art.

It will be noted that external passageways 24 are quite different from other external passageways 26, the latter of which are conventional in design, while the former is made in accordance with the present invention. The external passageways each have an inlet end 28 and an outlet end 30.

Figure 4:
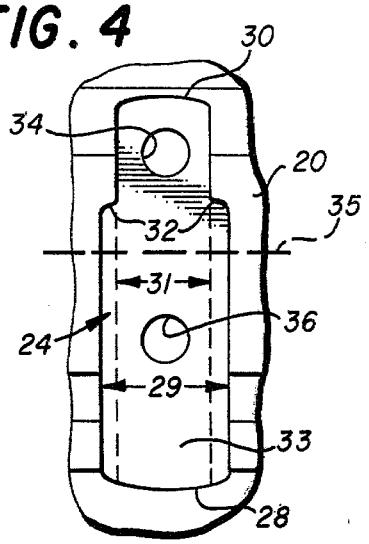
FIG. 4 is an enlarged, fragmentary, detail of part of the apparatus disclosed in FIG. 1.

As particularly illustrated in FIG. 4, together with FIGS. 1–3, it will be noted that the novel passageways 24 commences at the inlet end 28 and has a width 29 for a marginal length thereof. The length of the passageway is the distance measured from numeral 28 to numeral 30. The outlet end 30 of the passageway has a width indicated by the numeral 31. Hence, the passageway 31 has been enlarged at shoulder 32 to a greater width 29. The depth; that is, the distance measured from the innermost surface 33 to the outermost surface 20 of the main body preferably is constant along the entire length of the external passageway.

Upper and lower radial counterbores 34 and 36 are spaced apart from one another and from the longitudinal center of gravity 35 of the bit. Preferably there are two counterbores formed in diametrically opposed external passageways, as noted in FIG. 3. The counterbore has a blind end 37 spaced from the internal axial passageway 44 of the bit. The counterbores are arranged perpendicular respective to the axial passageway 44.

In FIG. 3, the bit breaker 12 is seen to have an outer geometrical configuration in the form of a polygon which coincides with the configuration of the socket of the kelly drive 14. The bit breaker includes an axial passageway 38 of a diameter to slidably receive the main body portion of the bit therewithin in a telescoping manner. Circumferentially spaced apart lugs 40 are affixed to the bit breaker and extend radially inwardly towards the axial passageway 44. The lugs preferably are an integral part of the plate member, and are of a size to be received in close tolerance relationship within the enlarged marginal inlet portion of the external passageway. Stated differently, the lugs have a width which is slightly less than the width 29 of the external passageway 24, and the lugs inwardly terminate in slightly spaced relationship respective to the inside wall 35 of the external passageway 24.

This configuration of the bit breaker causes the lugs thereof to be seated against shoulder 32 of the external passageway 24 when the bit is seated within the bit breaker in the illustrated manner of FIGS. 1 and 3.

Figure 5:
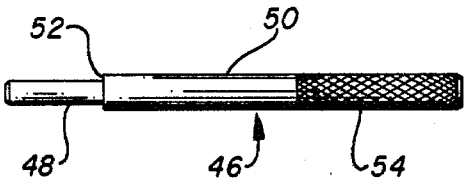
FIG. 5 is an enlarged, side elevational view of part of another embodiment of the present invention; and, FIG. 6 is a reduced, part diagrammatical, part schematical representation of one embodiment of the present invention.
Figure 6:
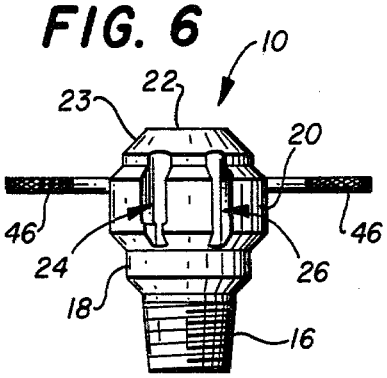

As seen illustrated in FIGS. 5 and 6, a bit handle 46 includes a reduced constant diameter marginal end 48 of a size to be telescopingly received in close tolerance relationship within the opposed counterbores 34 and 36. The handle includes a large constant diameter outer marginal length 50. Shoulder 52 is formed between the large and small diameter portions of the handle 50. The outer marginal end 54 of the handle preferably is knurled to increase the friction with which the roughneck can hold the handle. As seen in FIG. 6, two handles 46 have been placed within the bit 10.

It should be noted in FIG. 3 that there are six equally spaced apart external passageways. Counterbore 36 has been formed into diametrical opposed external passageways, with one passageway being made in the manner indicated by numeral 24, while the other passageway has been made in the manner illustrated by numeral 26.

Handles 56 and 58 extend upwardly from attached relationship respective to the upper face of the bit breaker plate member to facilitate manipulation of the plate member.

In operation, a workman lifts the bit breaker 12 by handles 56 and 58, and places the bit breaker within the kelly drive of a turntable. Next, two handles 46 are attached to a bit by inserting the reduced diameter marginal end portion 48 within the opposed counterbores 36 of the bit 10. Two roughnecks lift the bit and discover that the bit rotates into the inverted position. The bit is sat down on the pen end so that the cutting face 22 and 23 can be inspected to make certain that the bit is in satisfactory operating condition.

Next the handles are removed from counterbores 36 and placed within the opposed counterbore 34. The roughnecks lift the bit by the handles, and discover that the bit rotates into the illustrated position of FIG. 1. The bit is next placed within the bit breaker by properly aligning lugs 40 with external passageways 24. The aligned bit telescopingly descends through the bit breaker until shoulders 32 abuttingly engage the sides of the lugs 40. The bit is now safely seated in captured relationship respective to the turntable, and cannot possibly fall downhole into the borehole.

The pin end of the bit is doped, a stand of drill tubing is lifted by the traveling block and the box end thereof set down on the pin end of the bit. A backup is applied to the tubing string and the rotary table is engaged to make up the threads between the bit and the drill tubing.

After the bit has been properly torqued to the specified value, the traveling block lifts drill tubing and bit from the bit breaker, the bit breaker is lifted from the turntable by utilizing handles 56 and 58, and the drill bit and drill tubing is then run into the hole.

The bit is broke out from the drill tubing by reversing the above procedure.

In the illustrated embodiment set forth in the figures of the drawings, six external passageways have been selected for illustration, wherein alternant ones of the passageways have been modified for use in combination with the bit breaker of the present invention. Those skilled in the art, having read the above disclosure and studied the drawings thereof, will appreciate that the present invention can be practiced with a bit having any number of external passageways, and wherein any number of external passageways can be made in accordance with the present invention. It is contemplated that any drill bit can be modified in a manner to enable the present invention to be practiced therewith.

I claim:

1. In a drill bit for use in a rotary drilling rig, said bit having a main body which terminates in a formation engaging face at the lower end thereof and in a threaded fastener at the upper end thereof, said bit having a plurality of circumferentially spaced, external, outwardly opening passageways formed in said main body and communicating the lower end with the upper end of the bit, the combination with said bit of a bit breaker for making up and breaking out the threads of the bit with respect to the threads of a drill pipe;

said external passageways include spaced sidewalls which are joined to a bottom wall, said sidewalls of a marginal length of said passageway commencing at the lowermost end thereof are spaced from one another a greater distance respective to the sidewalls of the upper marginal terminal end of the external passageway thereby forming a shoulder at the sidewalls between the upper and lower marginal terminal ends;

said bit breaker has an outer perimeter in the form of a polygon which is of a complementary configuration respective to the geometrical configuration of the kelly drive of the rig, so that when the bit breaker is placed within the kelly drive of the rig, the rig turntable rotates the bit breaker about the central axis thereof;

said bit breaker has an axial passageway formed therethrough of a size to slidably receive said main body in a telescoping manner; a plurality of lugs affixed to said bit breaker and extending radially into the bit breaker axial passageway; said lugs being of a size to be received in close tolerance relationship within the lower marginal terminal end of said external passageway so that the lug abuttingly engages said shoulder and precludes further passage of the bit through the bit breaker;

whereby said bit breaker is placed within the kelly drive, said bit is seated within said bit breaker, so that the rotary table can turn the bit and bit breaker while a drill pipe is held stationary, to thereby enable the bit to be threadedly made up and broken out respective to the drill pipe.

2. The combination of claim 1 wherein said bit breaker is a flat metal plate in the form of a polygon which is drivingly engageable with the kelly drive of the drilling rig;

said bit breaker axial passageway is a circular hole interrupted by said lugs, said lugs are made integrally respective to said metal plate.

3. The combination of claim 2, and further including opposed counterbores formed within said main body and perpendicular respective to the longitudinal axial centerline of the bit; a handle for each counterbore, each handle has a reduced diameter marginal terminal end of a size to be removably fitted in close tolerance relationship within said counterbores, so that said handles can be used for lifting and manipulating the bit.

4. The combination of claim 3 wherein there are a lower pair of opposed counterbores and an upper pair of opposed counterbores; said upper pair of counterbores being placed above the center of gravity of the bit, said lower pair of counterbores being placed below the center of gravity of the bit, so that the handles can be placed in either of said opposed counterbores and the bit supported in either the upright or inverted position.

5. In a drill bit having a pin end spaced from a formation engaging face by an enlarged main body, and having circumferentially spaced external passageways formed within said main body for conducting fluid flow from said face to said pin end; the conbination with said bit of a bit breaker by which the bit can be made up and broken out respective to a threaded drill tubing;

said bit breaker having an outer configuration which enables said bit breaker to be drivingly received within a kelly drive of a turntable; a central aperture formed through said bit breaker;

said external passageways outwardly open radially away from said main body and have opposed sides which extend from a back wall, at least two said external passageways include a lower marginal terminal end adjacent to said face which is separated from an upper marginal end adjacent to said pin end by means forming a shoulder therebetween;

said bit breaker includes lugs affixed thereto and extending radially toward the center of said central aperture, said lugs having opposed sides and an inner end, said lug is received within the lower marginal terminal end of said passageway in close tolerance relationship therewith to cause said lug to abuttingly engage said shoulder when the bit is telescopingly received within said central aperture of said bit breaker, thereby releasably capturing the bit in seated relationship within said bit breaker;

whereby said bit breaker can be placed within a kelly drive, said bit can be seated within said bit breaker, the turntable can be rotated while a drill tubing is held stationary to thereby rotate the bit respective to the tubing and make up and break out the threaded ends of the tubing and bit.

6. The combination of claim 5 wherein the sidewalls of said lower marginal end of said passageways are spaced further apart respective to the sidewalls of said upper marginal terminal end thereof to thereby form said shoulder;

said passageways which have said shoulder formed therein are opposed to one another.

7. The combination of claim 6 wherein said bit breaker is a flat metal plate in the form of a polygon which is drivingly engageable with the kelly drive of the drilling rig;

said bit breaker axial passageway is a circular hole interrupted by said lugs, said lugs are made integrally respective to said metal plate.

8. The combination of claim 7 and further including opposed counterbores formed within said main body and perpendicular respective to the longitudinal axial centerline of the bit; a handle for each counterbore, each handle has a reduced diameter marginal terminal end of a size to be removably fitted in close tolerance relationship within said counterbores, so that said handles can be used for lifting and manipulating the bit.

9. The combination of claim 8 wherein there are a lower pair of opposed counterbores and an upper pair of opposed counterbores; said upper pair of counterbores being placed above the center of gravity of the bit, said lower pair of counterbores being placed below the center of gravity of the bit, so that the handles can be placed in either of said opposed counterbores and the bit supported in either the upright or inverted position.

* * * * *

UNITED STATES PATENT AND TRADEMARK OFFICE

CERTIFICATE OF CORRECTION

PATENT NO. : 4,352,399

DATED : October 5, 1982

INVENTOR(S) : KENNETH DAVIS

It is certified that error appears in the above—identified patent and that said Letters Patent is hereby corrected as shown below:

Claim 10. In a drill bit having a pin end spaced from a formation engaging face by an enlarged main body, and having circumferentially spaced external passageways formed within said main body for conducting fluid flow from said face upwards towards said pin end; and further including a bit breaker by which the bit can be made up and broken out respective to the lower threaded end of a string of drill tubing; the improvement comprising:

said bit breaker having an outer configuration which enables said bit breaker to be drivingly received within a kelly drive of a turntable; a central aperture formed through said bit breaker;

said spaced external passageways of said bit main body outwardly open in a direction radially away from said main body, said external passageways each have opposed sides which extend from a back wall, at least two said external passageways include a lower marginal terminal end adjacent to said face which is separated from an upper marginal end adjacent to said pin end by an abutment means formed therebetween;

said bit breaker includes lugs affixed thereto and extending radially toward the center of said central aperture, said lugs include opposed sides which terminate at an inner end, each said lug is received within the lower marginal terminal end of said external passageway in close tolerance relationship therewith to cause at least part of said lug to abuttingly engage at least part of said abutment means when the bit is telescopingly received within said central aperture of said bit breaker, thereby releasably capturing the bit in seated relationship within said bit breaker;

UNITED STATES PATENT AND TRADEMARK OFFICE

CERTIFICATE OF CORRECTION

PATENT NO. : 4,352,399

DATED : October 5, 1982

INVENTOR(S) : KENNETH DAVIS

It is certified that error appears in the above—identified patent and that said Letters Patent is hereby corrected as shown below:

whereby said bit breaker can be placed within a kelly drive, said bit can be seated within said bit breaker, the turntable can be rotated while a drill tubing is held stationary to thereby rotate the bit respective to the drill tubing and make up and break out the coacting threaded ends of the tubing and bit.

Claim 11. The combination of Claim 10 wherein said bit breaker is a flat metal plate in the form of a polygon which is drivingly engageable with the kelly drive of the drilling rig;

said bit breaker axial passageway is a circular hole interrupted by said lugs, said lugs are made integrally respective to said metal plate.

Claim 12. The combination of Claim 11 wherein the sidewalls of said lower marginal end of said passageways are spaced further apart respective to the sidewalls of said upper marginal terminal end thereof to thereby form said abutment means;

said passageways which have said abutment means formed therein are opposed to one another.

On the title page after the abstract, "9 Claims" should read -- 12 Claims --.

Signed and Sealed this

First Day of March 1983

[SEAL]

Attest:

GERALD J. MOSSINGHOFF

Attesting Officer

Commissioner of Patents and Trademarks